US007839064B2

(12) United States Patent
Yoshida et al.

(10) Patent No.: US 7,839,064 B2
(45) Date of Patent: Nov. 23, 2010

(54) SPARK PLUG FOR INTERNAL COMBUSTION ENGINE

(75) Inventors: Kazumasa Yoshida, Nagoya (JP); Kazuyoshi Torii, Aichi (JP); Wataru Matsutani, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 452 days.

(21) Appl. No.: 11/717,638

(22) Filed: Mar. 14, 2007

(65) Prior Publication Data

US 2007/0216277 A1 Sep. 20, 2007

(30) Foreign Application Priority Data

Mar. 14, 2006 (JP) ..... 2006-068673
Feb. 23, 2007 (JP) ..... 2007-043057

(51) Int. Cl.
*H01T 13/20* (2006.01)

(52) U.S. Cl. ..... 313/141

(58) Field of Classification Search ..... 313/141
See application file for complete search history.

(56) References Cited

U.S. PATENT DOCUMENTS 6,208,066 B1 * 3/2001 Kokubu et al. ..... 313/141
2002/0038992 A1 * 4/2002 Morita et al. ..... 313/141

FOREIGN PATENT DOCUMENTS

JP 5-13146 A 1/1993
JP 11-121142 A 4/1999

OTHER PUBLICATIONS

Machine translation of JP 2005-108794.*

* cited by examiner

*Primary Examiner*—Nimeshkumar D Patel
*Assistant Examiner*—Jacob Stern
(74) *Attorney, Agent, or Firm*—Sughrue Mion, PLLC

(57) ABSTRACT

A spark plug including: a center electrode as defined herein; a substantially cylindrical insulator as defined herein; a cylindrical metal shell as defined herein; and a ground electrode as defined herein, wherein a spark discharge gap is provided between the leading end portion of the center electrode and the leading end portion of the ground electrode, and the ground electrode has a bulging curved face on a side opposite to a side in which the center electrode is provided, and a maximum of width of the ground electrode within a range of ±1 mm from a center point of the spark discharge gap in the axial direction, as viewed in a direction where the center electrode and the ground electrode overlap, is 105% or less of a width of an ordinary portion having a substantially constant width.

11 Claims, 7 Drawing Sheets

SPARK PLUG FOR INTERNAL COMBUSTION ENGINE

FIELD OF THE INVENTION

The present invention relates to a spark plug to be used in an internal combustion engine and, more particularly, to a spark plug including a ground electrode having a bulging curved face on the back opposite to the side of the center electrode.

BACKGROUND OF THE INVENTION

As shown in FIG. 11, for example, the spark plug for an internal combustion engine such as an automotive engine is provided with a center electrode 81, an insulator 82 disposed on the outer side of the center electrode 81, a cylindrical metal shell 83 disposed on the outer side of the insulator 82, and a ground electrode 84 bonded at its rear end portion to the leading end portion of the metal shell 83. The ground electrode 84 is made by bending a metallic rod having a substantially square section toward the center at its longitudinally intermediate position. Moreover, the ground electrode 84 is arranged such that its leading end portion has its inner side face confronting the leading end face of the center electrode 81. As a result, a spark discharge gap is formed between the leading end portion of the center electrode 81 and the inner face of the leading end portion of the ground electrode 84.

A not-shown threaded portion is formed in the outer circumference of the metal shell 83. The spark plug is mounted in the cylinder head of the engine by fastening it at that threaded portion. In case the ground electrode 84 of the spark plug mounted and a mixture, as indicated by arrows, take the positional relation, as shown, in which the mixture impinges directly upon the back of the ground electrode 84, the ground electrode 84 may obstruct the inflow of the mixture to the spark discharge gap of the mixture. As a result, the mixture may find it difficult to reach the spark discharge gap thereby to deteriorate the ignitability.

In the spark plug of the type having two or more ground electrode, on the other hand, there is a technique (as referred to JP-A-11-121142, for example), in which the individual ground electrodes are formed into a cylindrical shape having a substantially circular section. With this substantially circular section, the mixture goes around to the inner side of the ground electrodes so that it easily reaches the spark discharge gap, even in the positional relation where the mixture impinges directly upon the backs of the ground electrodes.

SUMMARY OF THE INVENTION

As described above, however, the ground electrodes are bent at their longitudinally intermediate portions toward the center. As shown in FIG. 12, therefore, in a ground electrode 91 having a bent portion merely bent without exercising any ingenuity, the bent portion is pulled on the outer side (or the back side), and is collected on the inner side (or on the center electrode side) so that it is widthwise bulged by a distortion stress thereby to form widened portions 92. If, moreover, these widened portions 92 exist at a position corresponding to the center of the spark discharge gap, they may accordingly obstruct the inflow of the mixture to spark discharge gap. Even if, therefore, the ground electrode 91 is formed with effort into the circular section shape so that its advantage cannot be sufficiently attained to lose the meaning. Here, the widened portion is also formed even with the aforementioned ground electrode 84 having the substantially square section.

However, it can be said that the degree of influence of the widened portions 92 is especially serious, in case the ground electrode 91 is formed to have the circular section.

In order to reduce the aforementioned widening as much as possible, it is conceivable to make gentle the bending degree of the bent portion, that is, to enlarge the radius of curvature of the bent portion. In this case, the spacing between the center position of the spark discharge gap and the bent portion is narrowed to invite a reduced, combustion space. From the viewpoint of retaining the combustion space, therefore, the radius of curvature of the bent portion has to be reduced to some extent. In this case, however, the drawback due to the existence of the aforementioned widened portion 92 becomes serious.

The present invention has been conceived in view of the background thus far described, and has an object to provide a spark plug for an internal combustion engine, which includes a ground electrode bonded at its rear end portion to the leading end portion of a metal shell and bent at its bent toward the center so that its leading end portion is opposed to the leading end face of a center electrode, whereby it can suppress the obstruction of the inflow of a mixture into a spark discharge gap thereby to prevent the reduction in the ignitability.

The individual structures suitable for solving the aforementioned problem and so on are separately described separately in the following. The advantages intrinsic to the corresponding structures are additionally described, if necessary.

Structure 1: According to this Structure, there is provided a spark plug for an internal combustion engine comprising: a (rod-shaped) center electrode extending in an axial direction; a substantially cylindrical insulator disposed on the outer circumference of said center electrode; a cylindrical metal shell disposed around said insulator; and a ground electrode bonded at its rear end portion to the leading end portion of said metal shell, and including a bent portion bent at its intermediate body such that its leading end portion is opposed to the leading end face of said center electrode, wherein a spark discharge gap is formed between the leading end portion of said center electrode and the leading end portion of said ground electrode. The spark plug is characterized in that said ground electrode has a bulging curved face on a side opposite to a side in which said center electrode is provided, and the maximum of the width of said ground electrode within the range of ±1 mm from the center point of said spark discharge gap in the axial direction, as viewed in the direction where said center electrode and said ground electrode overlap, is 105% or less of the width of the ordinary portion having a substantially constant width.

Here, the "bent portion" may be more or less curved. Moreover, it is sufficient that the ground electrode is so arranged that the inner side face of its leading end portion confronts the leading end face of the center electrode.

Moreover, at least one of the ground electrode and the center electrode may be provided with a noble metal tip, for example. In case the center electrode is provided with the noble metal tip, the spark discharge gap is formed between the noble metal tip and the ground electrode body confronting each other. In case the ground electrode is provided with the noble metal tip, the spark discharge gap is formed between the noble metal tip and the center electrode body confronting each other. In case both of them are provided with the noble metal tips, the spark discharge gap is formed between the noble metal tips confronting each other. In case neither of them is provided with the noble metal tip, on the contrary, the spark discharge gap is formed between the leading end face of the center electrode and the inner side face of the ground electrode.

In addition, the "width" indicates the width taken in a direction perpendicular to the axial direction, as viewed in the direction where the center electrode and the ground electrode overlap.

In addition, the "ordinary portion" means that portion of the ground electrode, which is not influenced by the "bending", and indicates the portion widened by "bending", i.e., the portion having a substantially constant portion excepting the portion having the aforementioned maximum. In case, therefore, the ground electrode used is made by bending a rod having a section of the same size and the same shape in its entirety, the ordinary portion can be exemplified by the rear end portion on the side of the leading end face of the metal shell. In the meaning that no influence is received from the "bending", moreover, the ordinary portion can be thought as the same portion before bent. This is because the widening phenomenon is caused by the bending.

Moreover, the ground electrode need not always have the circular section but may have a bulging curved face at least on the back opposite to side of the center electrode side. This is because the mixture easily flows inward around the ground electrode and reaches the spark discharge gap, if at least, the back is rounded.

According to the aforementioned Structure 1, the ground electrode has the bulging curved face on the back opposite to side of the center electrode side. In case, therefore, the positional relation is made such that the mixture impinges directly upon the back of the ground electrode, the mixture can flow inward around the ground electrode so that it can easily reach the spark discharge gap.

If, moreover, the ground electrode is excessively widened by the bend in the vicinity of the center point of the spark discharge gap in the axial direction, it may obstruct to the inflow of the mixture. In this point, according to Structure 1, the maximum of the width of the ground electrode within the range of ±1 mm from the center point of the spark discharge gap in the axial direction, is suppressed at 105% or less of the width of the ordinary portion of the ground electrode. As a result, the influences due to the widening can be suppressed to the minimum so that the effect resulting from the bulging curved face on the back is not reduced. As a result, the obstruction to the inflow of the mixture can be suppressed to prevent the deterioration in the ignitability.

Thus, it can be said that the smaller width of the widened portion is the more preferred so that the inflow of the mixture to the spark discharge gap from the back of the ground electrode may not be obstructed. If, however, the width of the widened portion is constricted within 101%, it is feared that the bending degree (or the radius of curvature) at the bent portion of the ground electrode becomes excessive. In this case, in order to make proper the spark discharge gap to be formed between the leading end portion of the center electrode and the leading end portion of the ground electrode, the gap between the ground electrode and an insulating insulator has to be narrowed, and the frequency of occurrences of a transversely flying spark may increase when the spark plug becomes dirty. This transversely flying spark is a spark discharge, which leaks on the leading end face of the insulator so that it occurs in the radial direction between the center electrode and the metal shell. Even if, therefore, the mixture is ignited by that spark discharge, the flame core, just after ignited, is surrounded by the metal shell and the insulator, and may be unable to sufficiently grow and to reach a flameout. It follows that the occurrence frequency of the transversely flying spark is desired to be low. From this viewpoint, the following structures are desired.

Structure 2: In the aforementioned Structure 1, the spark plug of this Structure 2 is characterized in that the width of such a portion of said ground electrode as has the maximum is 101% or more with respect to the width of said ordinary portion.

According to Structure 2, it is easy to avoid the drawback due to the transversely flying spark, which is caused by suppressing the width of the widened portion forcibly to a small value.

Structure 3: In the aforementioned Structure 1 or 2, the spark plug of this Structure 3 is characterized in that the thickness of said ground electrode to the width of the ordinary portion is 0.5 is more.

In the case of a relatively small thickness, that is, in case the thickness of the ground electrode is smaller than the width of the ordinary portion, the widening degree of the bent portion may be relatively low. In the case of a relatively large thickness, that is, in case a ratio of the thickness of the ground electrode to the width of the ordinary portion is 0.5 or more, the widening degree at the bent portion is liable to become high. For the widening degree liable to become high at the bending time, the width of the ground electrode within the range of ±1 mm from the center point of the spark discharge gap in the axial direction is suppressed at 105% or less of the width of the ordinary portion of the ground electrode.

Structure 4: In the aforementioned Structure of any of 1 to 3, the spark plug of this Structure 4 is characterized in that the Vickers hardness of such a portion of said ground electrode as has the maximum (dmax) is 140% or more and 170% or less with respect to the Vickers hardness of said ordinary portion.

As described above, the ground electrode is formed into a complete mode generally by bending the rod-shaped metallic material. As a result, the bent portion is worked hard to have an increased hardness. If the bending work is performed so much that the ratio of the hardness of the bent portion to that of the ordinary portion exceeds 170%, the width of the bent portion itself becomes so excessive as to adversely affect the ignitability. If the hardness ratio is 140% or less, the ground electrode is bent so that the spark can be discharged in the spark discharge gap. It is feared that the gap between the ground electrode and the insulator is narrowed to cause the transversely flying spark when the spark plug is contaminated. It is, therefore, preferred that the bending work is performed to confine the hardness ratio to 140% or more and 170% or less.

Structure 5: In the aforementioned Structure of any of 1 to 4, the spark plug of this Structure 5 is characterized in that the curved portion of the back of said ordinary portion of said ground electrode has a radius of curvature of 0.5 mm or more and 1.3 mm or less.

Generally speaking, the advantage of the around-inflow of the mixture is the higher, as the radius of curvature of the back of the ordinary portion of the ground electrode is the smaller. In this respect, the curved portion of the back of the ordinary portion of the ground electrode is given the radius of curvature of 0.5 mm or more and 1.3 mm or less so that the effect by the around-inflow of the mixture is more reliably attained. In case, on the other hand, the radius of curvature is less than 0.5 mm, the working operation becomes seriously difficult. Moreover, the upper limit exists in the width (or the thickness) of the cylindrical metal shell so that the joint of the ground electrode to the metal shell is difficult when the radius of curvature exceeds 1.3 mm.

Structure 6: In the aforementioned Structure of any of 1 to 5, the spark plug of this Structure 6 is characterized: in that said ground electrode includes an outer layer and an inner layer made of a metal having a higher thermal conductivity than that of said outer layer; and in that the ratio, as taken in the section of said ordinary portion, of the sectional area of said inner layer to that of said ordinary portion is 25% or more and 60% or less.

According to Structure 6, the ground electrode includes the inner layer made of a metal having a higher thermal conductivity than that of the outer layer. As a result, the so-called "heat release" is improved to suppress the trouble due to the rise of the temperature of the ground electrode at a high-speed running time or the like. Here, the material for making the outer layer is enumerated by a nickel alloy, and the material for making the inner layer is enumerated by a metallic material composed mainly of copper, or highly pure nickel more excellent in thermal conductivity than the nickel alloy. With this material structure, the inner layer has a tendency to be softer than the outer layer so that it is excellent in shape followability. As the ratio of the inner layer is the higher, therefore, the ground electrode has the higher shape followability, and can be said to have a tendency to cause the width widening, as might otherwise occur due to the excessive distortion stress. In case, therefore, the ratio of the sectional area of the inner layer to that of the ordinary portion is 25% or more, a sufficient shape followability can be expected even if the inner layer is especially formed. This may prevent the width widening. In case, on the other hand, the ratio of the sectional area of the inner layer to that of the ordinary portion is 60% or less, the possibility can be prevented that the outer layer becomes so thin that it is broken by the distortion stress due to the bend.

Structure 7: In the aforementioned Structure of any of 1 to 6, the spark plug of this Structure 7 is characterized in that said ground electrode has at least one bent portion outside of said range of ±1 mm from the center point of said spark discharge gap in said axial direction.

According to Structure 7, the aforementioned spark discharge gap is formed by disposing the bent portion at the portion, which deviates the aforementioned range liable to exert influences on the ignitability. This formation makes less the adverse affections on the ignitability, i.e., the degree of obstruction to the inflow of the mixture to the spark discharge gap, than those of the case, in which the widened portion is formed in the aforementioned range. It is, therefore, preferable that one or more bent portions are so formed that the widened portion (including a widened portion having a width of 105% or more of that of the ordinary portion of the ground electrode) may be positioned outside of the aforementioned range. This is because the obstruction to the inflow of the mixture to the spark discharge gap is not or little, even if the widened portion is outside of said range.

DETAILED DESCRIPTION OF THE INVENTION

Figure 1:
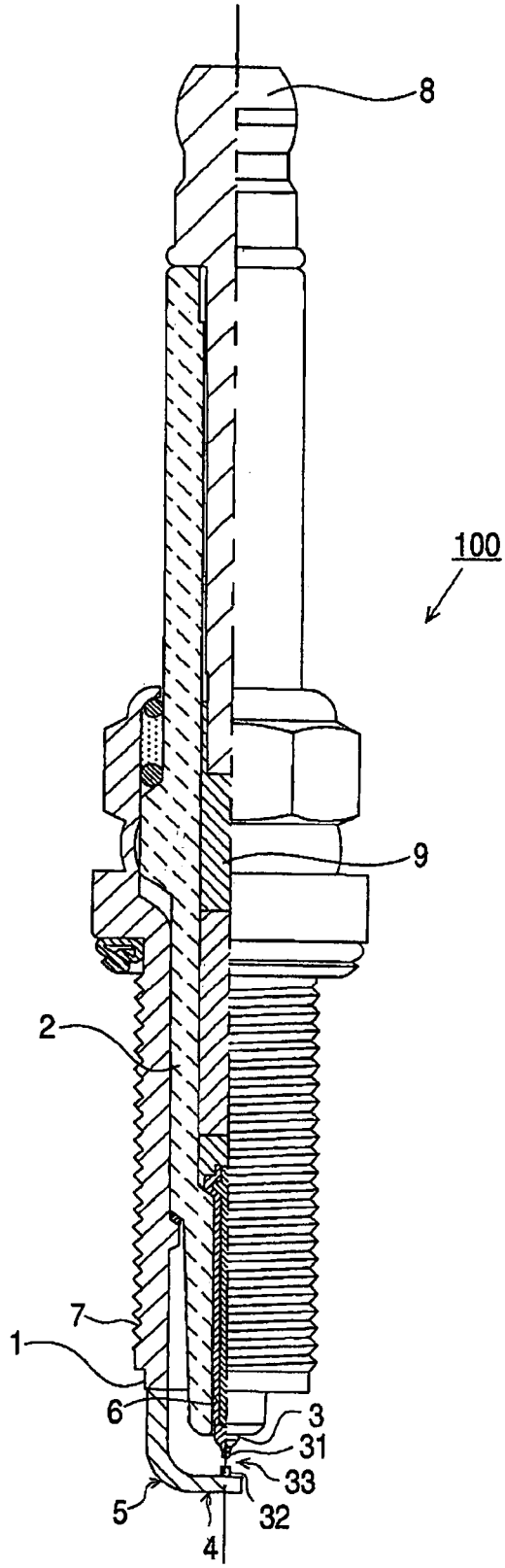
FIG. 1 is a partially broken front elevation the entire structure of a spark plug of a mode of embodiment.
Figure 2:
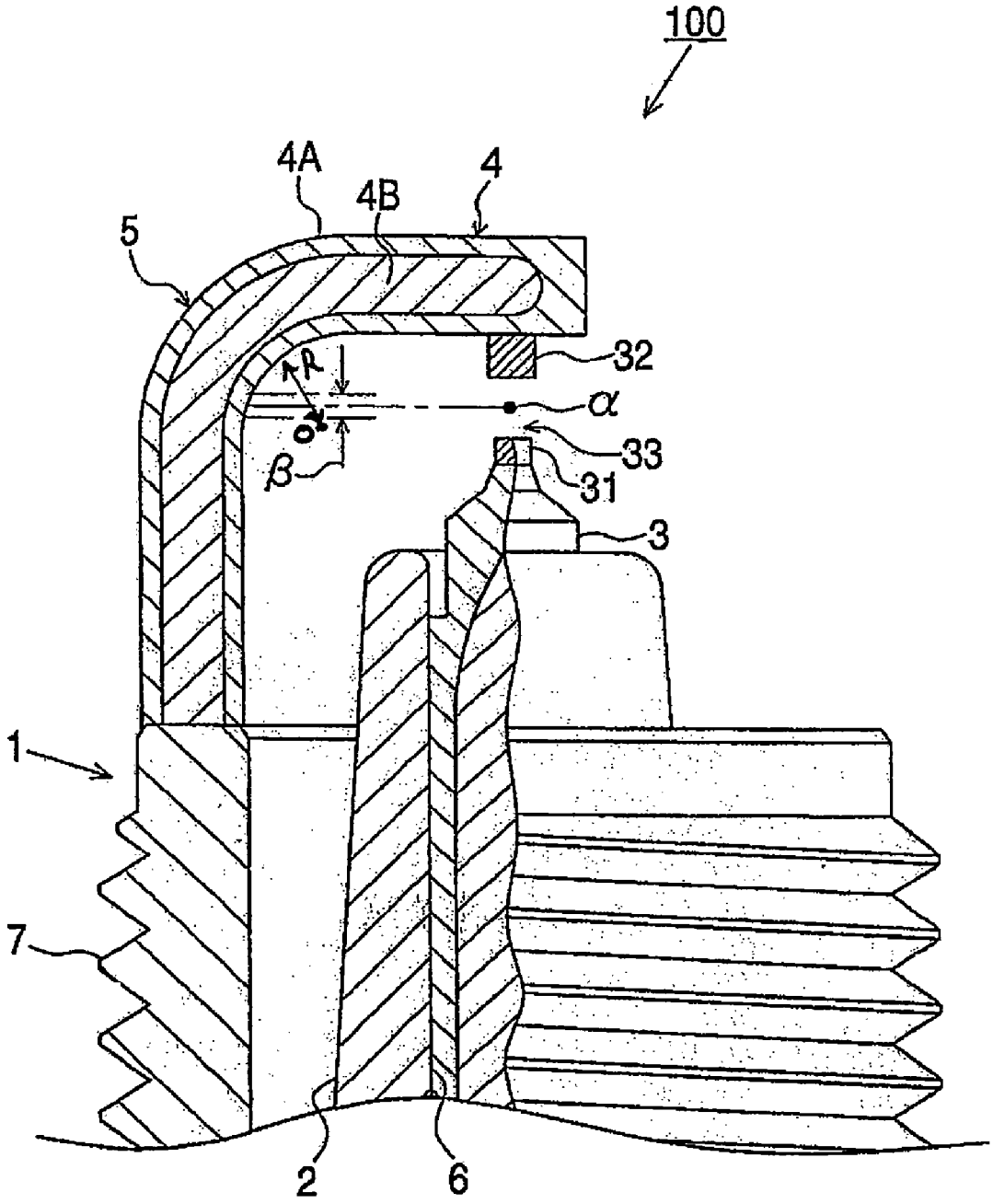
FIG. 2 is a partially broken front elevation showing the structure of a major portion of the spark plug of the mode of embodiment.

One mode of embodiment of the invention is described in the following with reference to the accompanying drawings. FIG. 1 is a view showing the entire structure of a spark plug 100 of this mode of embodiment, and FIG. 2 is a partially broken front elevation showing a major portion. The following description will be made mainly with reference to FIG. 2.

As shown in FIG. 1, the spark plug 100 of this mode of embodiment is provided with a metal shell 1, an insulator 2, a center electrode 3 and a ground electrode 4. The metal shell 1 is formed into a cylindrical shape, and holds the insulator 2 in its inner side. On the other hand, the center electrode 3 is so disposed in the inner side of the insulator 2 as to protrude a noble metal tip 31 at its leading end. Moreover, the ground electrode 4 is welded at its rear end face to the leading end face of the metal shell 1, and is bent toward the center at a bent portion 5 at a longitudinally intermediate portion. Moreover, the ground electrode 4 is so arranged that the inner side face of its leading end portion confronts the leading end face of the center electrode 3. In the inner side face of the ground electrode 4, there is disposed a noble metal tip 32, which confronts the noble metal tip 31. These noble metal tip 31 and noble metal tip 32 defines a spark discharge gap 33 inbetween.

The insulator 2 is made of sintered ceramics such as alumina having a hole portion 6 formed in its own axial direction for arranging the center electrode 3. On the other hand, the metal shell 1 is formed of a metal such as low carbon steel into a cylindrical shape to make the housing of the spark plug 100, and is threaded in its outer circumference to form a threaded portion 7 for mounting the spark plug 100 in the cylinder head of the not-shown engine.

On the other hand, the ground electrode 4 has its body portion formed of a two-layered structure of an outer layer 4A and an inner layer 4B. The outer layer 4A is made of a nickel alloy or the like. On the contrary, the inner layer 4B is made of a thermally more conductive metal (e.g., a metallic material mainly composed of copper, or highly pure nickel superior in thermal conductivity to the nickel alloy) than the nickel alloy. In this mode of embodiment, especially in the bent portion 5 excepting the leading end portion, the ratio of the sectional area of the inner layer 4B to that of the ground electrode 4 is set at 25% or more to 60% or less (e.g., at 36%). The heat release, (or the heat radiation) is improved by the presence of the inner layer 4B. In this mode of embodiment, the body portion of the center electrode 3 also has the two-layered structure of an inner layer and an outer layer.

The noble metal tip 31 on the side of the center electrode 3 is made of a noble metal alloy containing iridium as a main component, 10 mass % of platinum, 3 mass % of rhodium and 1 mass % of nickel, for example. Moreover, the noble metal tip 32 on the side of the ground electrode 4 is made of a noble metal alloy containing platinum as a main component, and a noble metal alloy containing 20 mass % of iridium and 5 mass % of rhodium. However, these material components are presented merely for examples but should not raise any restriction. These individual noble metal tips 31 and 32 are formed by fixing tips of a predetermined shape (e.g., a cylindrical shape) along the outer edge portions of the individual joint faces to the center electrode 3 or the ground electrode 4 by a laser-welding method, an electron-beam welding method, a low-resistance-welding method or the like.

In this mode of embodiment, both the electrodes 3 and 4 are provided with the noble metal tips 31 and 32, but either the ground electrode 4 or the center electrode 3 may also be provided with the noble metal tip. In case only the center electrode 3 is provided with the noble metal tip 31, the spark discharge gap is formed between the noble metal tip 31 and the ground electrode 4 confronting each other. In case only the ground electrode 4 is provided with the noble metal tip 32, the spark discharge gap is formed between the noble metal tip 32 and the center electrode 3 confronting each other. Alternatively, neither of the electrodes may also be provided with the noble metal tip. In this case, the spark discharge gap 33 is formed between the leading end face of the center electrode 3 and the inner side face of the ground electrode 4.

Figure 3:
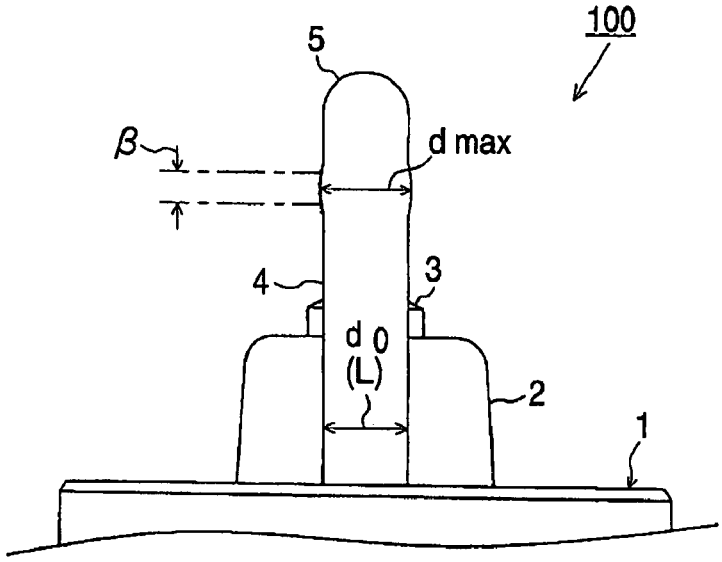
FIG. 3 is a side elevation showing the spark plug, as taken from a direction normal to FIG. 2.
Figure 4:
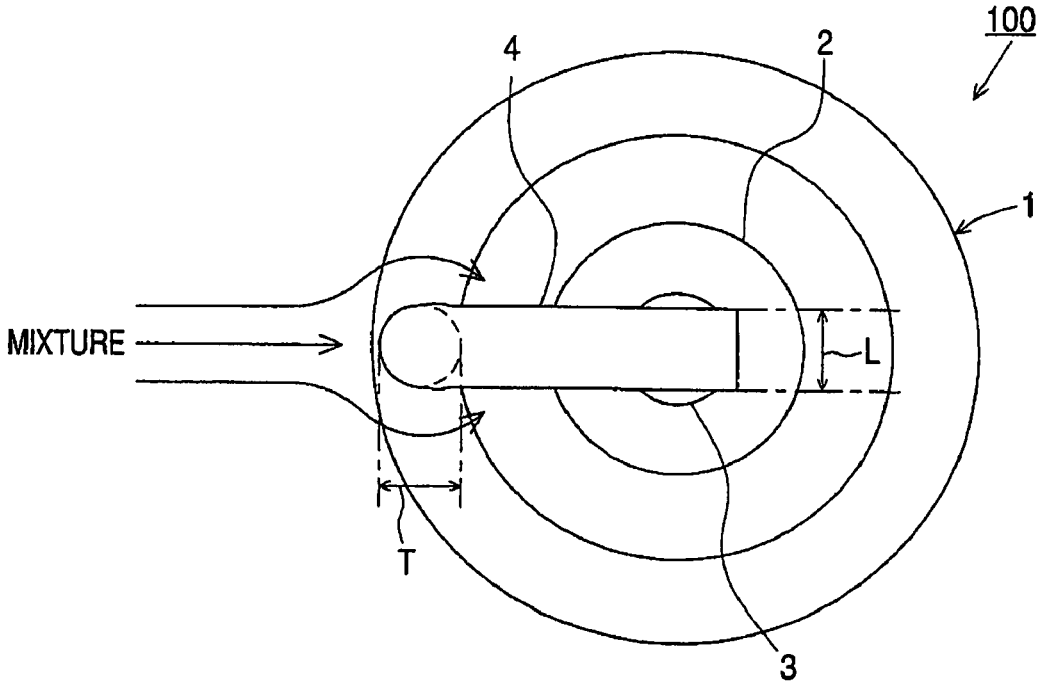
FIG. 4 is a top plan view showing the spark plug in the state taken from the leading end side.

Here in this mode of embodiment, as shown in FIGS. 2, 3 and 4, the ground electrode 4 is formed to have a circular section of a diameter of 1.3 mm. Specifically, the ground electrode 4 is made to have a bulging face on the back opposite to the side of the center electrode 3. As a result, even in case the positional relation is so made with the spark plug 100 being mounted that a mixture impinges directly upon the back of the ground electrode 4, the mixture can flow inward around the ground electrode 4 so that it can easily reach the spark discharge gap 33.

In this mode of embodiment, moreover, the maximum dmax of the width of the ground electrode 4 within a range (i.e., an area β of FIG. 2) of ±1 mm from the center point a of the spark discharge gap 33 in the axial direction, as viewed in the direction where the center electrode 3 and the ground electrode 4 overlap, is set at 105% or less (e.g., 103%) of a width d0 of such an ordinary portion (e.g., an arbitrary position of the route end portion of the metal shell 1 on the leading end face side an arbitrary portion of the ground electrode 4 before bent, in this mode of embodiment) as extrudes the portion having the maximum dmax and as has a substantially constant width. Moreover, a ratio of the thickness T of the ground electrode 4 to the width L of the ordinary portion is 0.5 or more (e.g., 1.0 in this mode of embodiment having a circular section).

Here is briefly described a method for manufacturing the spark plug 100 thus made. First of all, the metal shell 1 is treated in advance. Specifically, a cylindrically formed metallic material (e.g., an iron material or a stainless steel material such as S15C or S25C) is subjected to a cold forging treatment so that a general shape is formed with a through hole. After this, a cutting treatment is performed to arrange the contour thereby to prepare an intermediate metal shell.

Subsequently, the ground electrode 4 is resistance-welded to the leading end portion of the intermediate metal shell. In this welding operation, the so-called "sagging" takes place. After this "sagging" was removed, the intermediate metal shell is rolled to form the threaded portion 7 at its predetermined portion. As a result, the metal shell 1 having the ground electrode 4 welded thereto is obtained. The metal shell 1 having the ground electrode 4 welded thereto is plated with zinc or nickel. This plated surface may also be further plated with chromate.

Moreover, the aforementioned noble metal tip 32 is bonded to the leading end portion of the ground electrode 4 by a resistance-welding method, a laser-welding method or the like. In order to ensure the weld more reliable, the plating may be removed, before welded, from the portion to be welded, or the portion to be welded may be masked at the plating step. Alternatively, the tip may be welded after a later-described assembling step.

Separately of the metal shell 1, the insulator 2 is molding-manufactured in advance. For example, granules of a material for molding are prepared by using a powder material mainly composed of alumina and containing a binder or the like, and are subjected to a rubber pressing treatment to prepare a cylindrical molding. This molding is shaped by a grinding operation. This shaped molding is poured into and sintered by a furnace thereby to produce the insulator 2.

Separately of the metal shell 1 and the insulator 2, moreover, the center electrode 3 is prepared. Specifically, a Ni-based alloy is forged, and a copper core is embedded in the forged alloy to improve the heat radiation. The aforementioned noble metal tip 31 is bonded to the leading end of the center electrode 3 by a resistance-welding method, a laser-welding method or the like.

Then, the center electrode 3, to which the noble metal tip 31 thus obtained is bonded, and the terminal fitting 8 are sealed and connected in the hole portion 6 of the insulator 2 by means of the glass seal 9. The glass seal 9 is generally exemplified by a mixture prepared by mixing borosilicate glass and metal powder. At first, the center electrode 3 is inserted into the hole portion 6 of the insulator 2, and the aforementioned prepared seal member 9 is poured into the hole portion 6 of the insulator 2. After this, the aforementioned terminal fitting 8 is pushed from the back, those components are sintered in the furnace. A glaze layer may be simultaneously sintered on the surface of the trunk portion of the insulator 2 on the rear end side, or the glaze layer may also be formed beforehand.

After this, there are assembled the insulator 2 having the center electrode 3 and the terminal fitting 8 and the metal shell 1 having the ground electrode 4, which have been individually prepared, as described above. More specifically, the metal shell 1 made relatively thin is subjected at its rear end portion to the cold-fastening treatment or the hot-fastening treatment, so that the insulator 2 is held to have its portion enclosed by the metal shell 1.

At last, the ground electrode 4 is bent to adjust the aforementioned spark discharge gap 33 between (the noble metal tip 31) of the center electrode 3 and (the noble metal tip 32) of the ground electrode 4. In this mode of embodiment, at the time of forming the bent portion 5, various ingenuities are exercised such that the maximum dmax of the width of the ground electrode 4 within the range of ±1 mm from the center point a of the spark discharge gap 33 in the axial direction, is suppressed at 105% or less of the width d0 of the ordinary portion. The method for the bending treatment in this mode of embodiment is exemplified by (1) the method of bending slowly for a long time, (2) the method of bending at multiple stages while changing the bending points, (3) the method of bending while holding the portion which might otherwise be widened, and (4) the method of cutting after the bending treatment.

The spark plug 100 having the structure thus far described is manufactured by the series of steps thus far described.

According to this mode of embodiment, as has been described hereinbefore, the ground electrode 4 has the bulging curved face on the back opposite to the side of the center electrode 3 (i.e., has the circular section) Even if, therefore, the mixture takes a positional relation to make direct contact with the back of the ground electrode 4, as shown in FIG. 4, the mixture flows inward around the ground electrode so that the mixture can easily reach the spark discharge gap.

If, moreover, the ground electrode is excessively widened by the bend in the vicinity of the center point of the spark discharge gap in the axial direction, it may obstruct to the inflow of the mixture. In this point, the maximum dmax of the width of the ground electrode 4 within the range of ±1 mm from the center point a of the spark discharge gap 33 in the axial direction, is suppressed at 105% or less of the width d0 of the ordinary portion, as has been described hereinbefore. As a result, the influences due to the widening can be suppressed to the minimum so that the effect resulting from the bulging curved face on the back is not reduced. As a result, the obstruction to the inflow of the mixture can be suppressed to prevent the deterioration in the ignitability.

In the relatively thick case in which the thickness T of the ground electrode 4 with respect to the width L of the ordinary portion is 0.5 or more, as in this mode of embodiment, the bent portion 5 is liable to be excessively widened. Thus, the aforementioned effect is more meaningful, because the widening at the bending time is suppressed although might otherwise become excessive.

In order to confirm the aforementioned advantages, various samples were made by varying the conditions, and were evaluated in various manners. These experimental results are discussed in the following.

Figure 5:
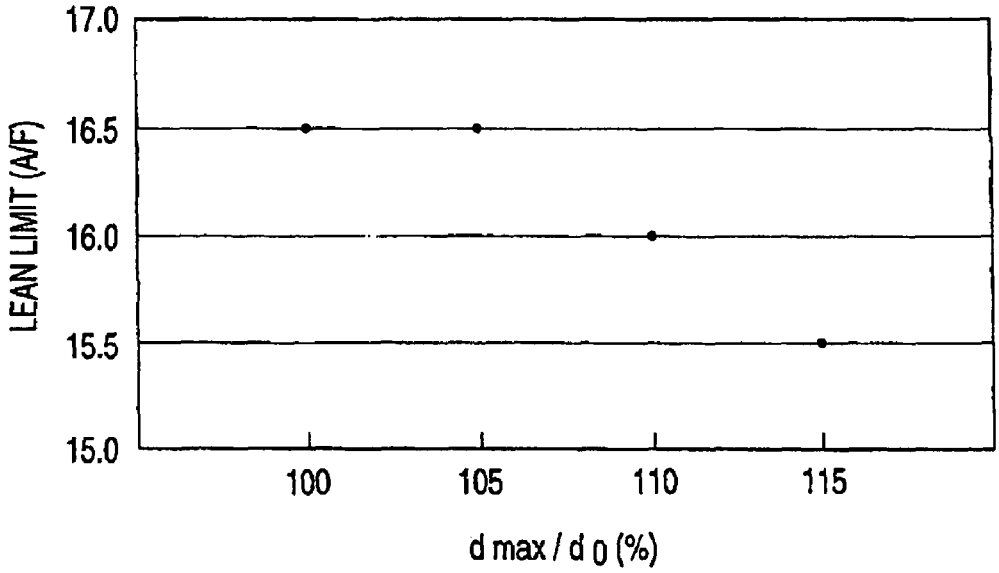
FIG. 5 presents a graph plotting the measurement results of a lean limit, as obtained by preparing samples, in which the ratios (dmax/d0) of the maximum dmax of the width of the ground electrode within the range of ±1 mm from the center point α of the spark discharge gap in the axial direction, to the width of the ordinary portion of the ground electrode were variously different and in which the positional relation was made such that the mixture impinged direction upon the back of the ground electrode.

First of all, there were prepared samples (of the spark plug), in which the ratios (dmax/d0) of the maximum dmax of the width of the ground electrode 4 within the range of ±1 mm from the center point a of the spark discharge gap 33 in the axial direction, to the width d0 of the ordinary portion of the ground electrode were variously different. The positional relation was so made that the mixture might impinge directly upon the back of the ground electrode. Thus, ignitability limit air/fuel ratios (or lean limit (A/F)) were measured. Upon measurements, the individual samples (or spark plugs) of the evaluation test objects assembled with the ignition devices were attached to a testing chamber, and this testing chamber was filled with an evaluation mixture of the atmosphere and propane. The spark plugs were discharged to confirm whether or not the mixture was ignited. To the inside of the testing chamber, there was attached a fan, which was activated to establish the flow of the mixture from the back of the ground electrode to the spark discharge gap when the spark plug was discharged. These measurements are tried ten times when the mixture ratios (or the air/fuel ratios) were changed for the individual samples, and the mixture ratios at the time when two misfires occurred were adopted as the ignitability limit air/fuel ratios. The results are plotted in the graph of FIG. 5. As shown in FIG. 5, all the lean limits (A/F) of the samples having the ratios (dmax/d0) of 100% and 105% are 16.5, whereas the two lean limits (A/F) of the samples having the ratios (dmax/d0=110% and 115%) more than 105% are individually as low as 16.0 and 15.5. From these results, it can be said that the obstruction of the mixture inflow by the widening can be suppressed at the ratio (dmax/d0) of 105% or less, and that the ignitability can be prevented from lowering.

Figure 6:
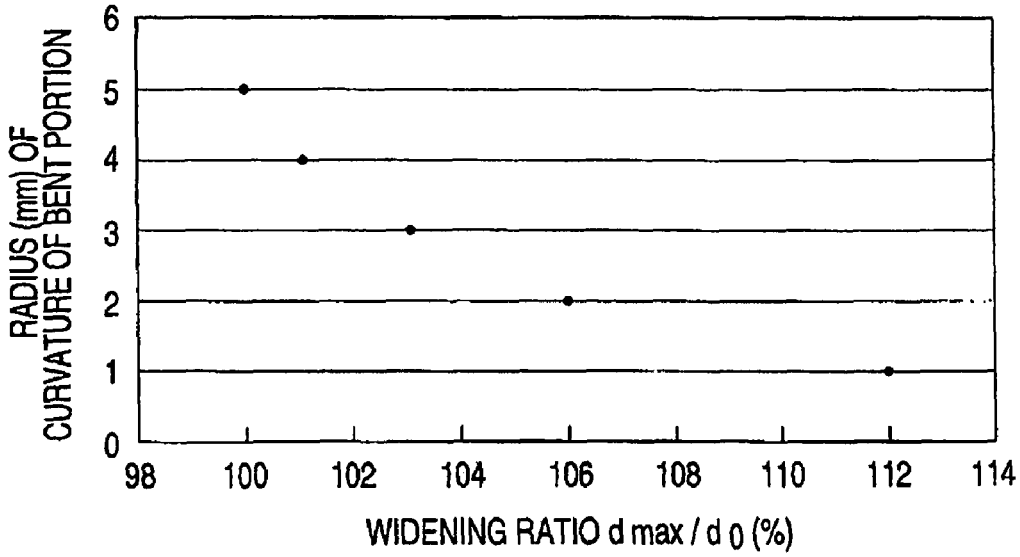
FIG. 6 is a graph plotting the relation between the widening ratio of the widened portion to the ordinary portion and the radius of curvature of the bent portion.

Next, the widened portion and the occurrence of a transversely flying spark were verified on their correlations. The samples were prepared at first by bending them to have the widened portions of different ratios of 100%, 101%, 103%, 106% and 112% of the ordinary portion. For the bending treatments, all the samples were prepared to have a common spark discharge gap. For these spark plugs of five kinds, it can be confirmed that the relation shown in FIG. 6 exists between the widening ratio of the widened portions to the ordinary portion and the radius of curvature of the bent portions.

Figure 7:
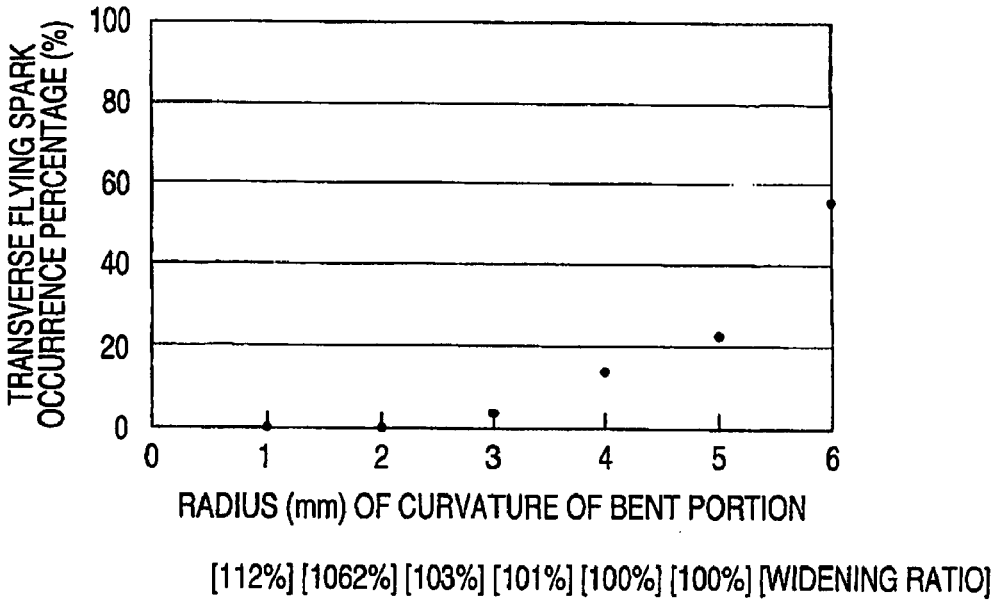
FIG. 7 is a graph plotting the relation between the radius of curvature of the bent portion, i.e., the "widening ratio of the widened portion to the ordinary portion" and an occurrence ratio of transverse flying spark.

Moreover, the same samples were used to confirm the correlations of the radius of curvature of the bent portions and the percentage of occurrences of the transverse flying sparks. For the evaluation tests, silver paste was applied to the surfaces of the leading end portions of the insulators thereby to simulate the state, in which the spark plugs, were contaminated. The valuation tests were performed by the spark discharge tests of the atmospheric atmosphere and the environment of 0.6 MPa, and the number of transverse flying sparks, which occurred when one hundred spark discharges were caused for the individual samples, was counted. The test results are plotted in FIG. 7.

According to these test results, it can be confirmed that the transverse flying spark occurrence percentages abruptly rise across the bent portion of curvature radius of 5 mm, i.e., across the widening ratio of 100%. Therefore, it can be confirmed that the widening ratio of 101% or more is preferable. As a result, it is estimated that the transverse flying spark occurrence percentage can be suppressed less than 20%, if the radius of curvature of the bent portion is 4.5 mm.

Figure 8:
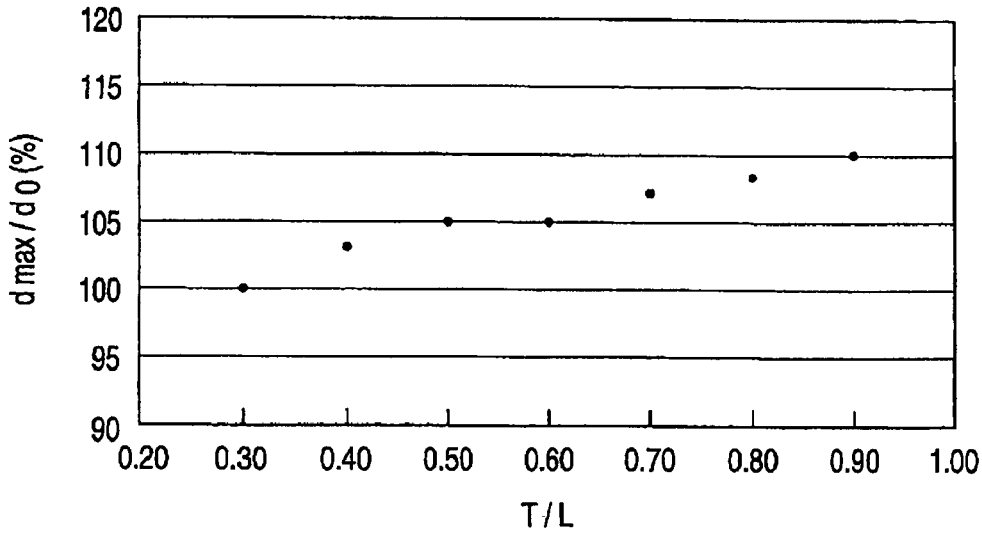
FIG. 8 is a graph plotting the measurement results of the ratio (dmax/d0) when rod-shaped samples having variously different thicknesses to the width of the ordinary portion of the ground electrode were prepared and simply bent.

Next, there were prepared rod-shaped samples, which had variously different thicknesses T to the width L of the ordinary portion of the ground electrode. The ratios (dmax/d0) were measured at the time when the samples were simply bent. In this case, the thickness T was fixed at 1.3 mm, and the bending operation was performed at a constant rate like the prior art. The results are plotted in FIG. 8. In case the thickness T to the width L (as will be conveniently called the "aspect ratio T/L") was less than 0.5, as shown in FIG. 8, the widening extent was a little even if the samples were simply bent. In case the aspect ratio T/L was 0.5 or more, on the other hand, it is found that the simple bending operation increased the ratio (dmax/d0) to 105% or more and according the widening degree. In the case of the relatively large thickness of the aspect ratio T/L of 0.5 or more, the widening degree at the bent portion was liable to become large. It can be said that the aforementioned advantage had a high meaning because the ratio (dmax/d0) was 105% or less.

Subsequently, there were prepared the rod-shaped samples, of which the external diameter was set constant at 1.3 mm, and in which the ratios of the sectional area of the inner layer to the total area (or the entire area) of the section were made variously different. The measurements were performed on the ratio (dmax/d0) and on the presence/absence of the breakage of the outer layer, when those samples were simply bent. The bending operations were slowly performed at a lower rate than that of the prior art. The results are shown in Table 1.

TABLE 1

| Sample No. | Outer Dia.(mm) | Inner Layer Dia.(mm) | Inner Layer Area/Total Area | dmax/d0 | Breakage of Outer Layer |
|---|---|---|---|---|---|
| 1 | 1.3 | 0.3 | 0.05 | 1.11 | OK |
| 2 | 1.3 | 0.4 | 0.09 | 1.10 | OK |
| 3 | 1.3 | 0.5 | 0.15 | 1.08 | Ok |
| 4 | 1.3 | 0.6 | 0.21 | 1.07 | Ok |
| 5 | 1.3 | 0.7 | 0.29 | 1.05 | OK |
| 6 | 1.3 | 0.8 | 0.38 | 1.05 | OK |
| 7 | 1.3 | 0.9 | 0.48 | 1.03 | OK |
| 8 | 1.3 | 1.0 | 0.59 | 1.01 | OK |
| 9 | 1.3 | 1.1 | 0.72 | 1.00 | NG |
| 10 | 1.3 | 1.2 | 0.85 | 1.00 | NG |

With Samples 1 to 4 having the ratios of the inner layer areas of 25% or less to the total area, as shown in Table 1, there was no special problem to the breakage of the outer layer. However, the ratio (dmax/d0) exceeded 1.05. From this, it can be said that a sufficient shape following performance cannot be expected to cause the widening even with a relatively soft inner layer, in case the ratio of the sectional area of the inner layer to that of the ordinary portion is less than 25%.

With Samples 9 and 10 having the ratios of the inner layer area exceeding 60% to the total area, the breakage of the outer layer was found while the ratio (dmax/d0) being left at 1.00. From this, it can be said that the higher area ratio of the inner layer improves the shape following performance the better and makes the widening the more reluctant to occur due to an excessive distortion stress. In case the ratio of the sectional area of the inner layer to that of the ordinary portion exceeds 60%, on the other hand, it is feared that the outer layer may become so thin as to be broken by the bending distortion stress.

With Samples 5 to 8 having the ratios of the inner layer areas of 25% or more and 60% or less to the total area, neither the ratio (dmax/d0) exceeded 1.05, nor broke the outer layer. From this, the following items can be said. By forming the inner layer, the so-called "heat release" is improved to suppress the trouble due to the rise of the temperature of the ground electrode 4 at a high-speed running time or the like. By setting the ratio of the sectional area of the inner layer to that of the ordinary portion to 25% or more and 60% or less, moreover, the widening can be effectively suppressed together with the breakage of the outer layer.

Further verifications were made on the ratios of the hardness of the widened portions to those of the ordinary portions. As has been described hereinbefore, it can provide a satisfactory result in the aspect of the ignitability that the width of the widened portion to that of the ordinary portion is 101% or more and 105% or less. The hardness in the widened portion is closely related to the width of the widened portion, and this relation was confirmed.

At first, there were prepared a plurality of incomplete spark plugs, in which the ground electrodes had not been bent. The plural spark plugs were completed by making the ground electrode bending conditions variously different. The surface hardness (Vickers hardness) of the widened portions of the individual spark plugs completed was measured. These spark plugs were divided into five kinds having the hardness ratios 130%, 140%, 155%, 170% and 180% (of tolerances of ±2%) of the widened portions to the ordinary portions. Thirty spark plug thus divided were prepared. Next, the widths of the widened portions and the radii of curvature of the bent portions were measured on (1) the number of kinds, in which the widths of the widened portions to that of the ordinary portion was 105% or more, (2) the number of kinds, in which the widths of the widened portions of that of the ordinary portion was less than 101%, and (3) number of kinds, in which the radii of curvature of the bent portions exceeded 4.5 mm. The results are shown in Table 2.

TABLE 2

| Bending Hardness (%) | No. (N = 30) of Bulges >105% | No. of Bulges <101% | No. of Radii of Curvature >4.5 mm | Decision |
|---|---|---|---|---|
| 130 | 0 | 8 | 5 | Poor |
| 140 | 0 | 1 | 0 | Good |
| 155 | 0 | 0 | 0 | Good |
| 170 | 1 | 0 | 0 | Good |
| 180 | 10 | 0 | 0 | Poor |

As apparent from Table 2, the width of the widened portion to that of the ordinary portion exceeded 105% in one Sample, in case the hardness ratio was 170%, and in ten Samples in case the hardness ratio was 180%. In case the hardness ratio was 130%, 140% or 150%, on the contrary, the number of Samples was "0". If the hardness ratio is 170%, therefore, few Samples have the widening ratio exceeding 105%. The hardness ratio of 180% is not acceptable because Samples having the widening ratio exceeding 105% abruptly increase.

Moreover, the number of Samples, in which the width of the widened portion to that of the ordinary portion was less than 101%, was one in case the hardness ratio was 140%, and eight in case the hardness ratio was 130%. On the other hand, the number of the case, in which the hardness ratios were 155%, 170% and 180%, was "0". Therefore, it can be said that Sample of the hardness ratio of 130% is excellent from the viewpoint of the around-inflow of the mixture. On the other hand, five Samples having the hardness ratio of 130% exceed the radius of curvature of 4.5 mm, so that they are inferior in the ignitability because they experience the transverse flying sparks.

From the results thus far described, it can be said that the hardness ratio is closely related to the width of the widened portion, and that the hardness ratio is preferred to be 140% or more and 170% or less.

Here, the invention should not be limited to the aforementioned contents of the mode of embodiment, but may be embodied in the following manner, for example.

Figure 9A:
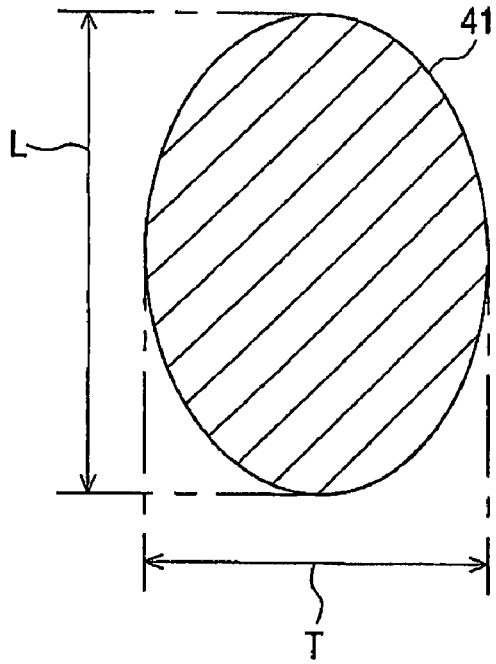
FIGS. 9A and 9B are diagrams both showing the sectional shapes of ground electrodes of different modes of embodiment.
Figure 9B:
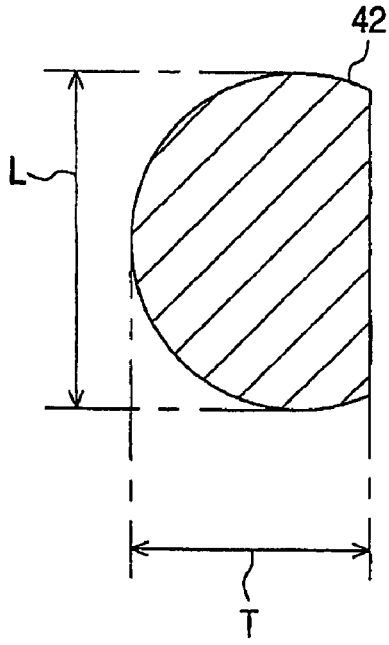

(a) The aforementioned mode of embodiment is exemplified in case the ground electrode 4 has the circular section, but the invention should not necessarily be limited to the circular section. Specifically, the ground electrode may have a bulging face on the back opposite to the side of the center electrode 3. For example, a ground electrode 41 may have an elliptical section, as shown in FIG. 9A, or a ground electrode 42 may have such a circular section as is partially cut off, as shown in FIG. 9B. If the center electrode side is a flat face in this modification, there arises a merit that the work to weld the noble metal tip 32 is advantageously facilitated. It is natural that the ground electrode may have a section of a semicircular shape or an elliptical shape, or may have different curvatures midway of the back. In order to make the invention more advantageous, however, the aspect ratio of T/L is more desired to be 0.5 or more.

Figure 10:
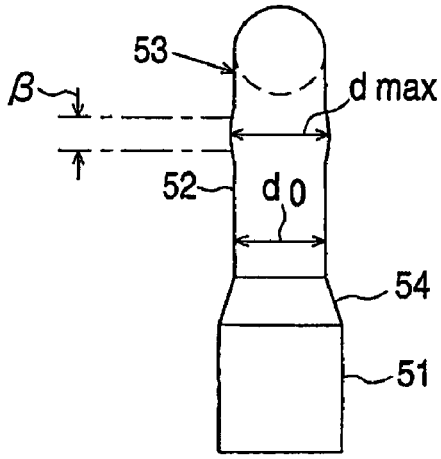
FIG. 10 is a view showing a side shape of a ground electrode according to another mode of embodiment.
Figure 11:
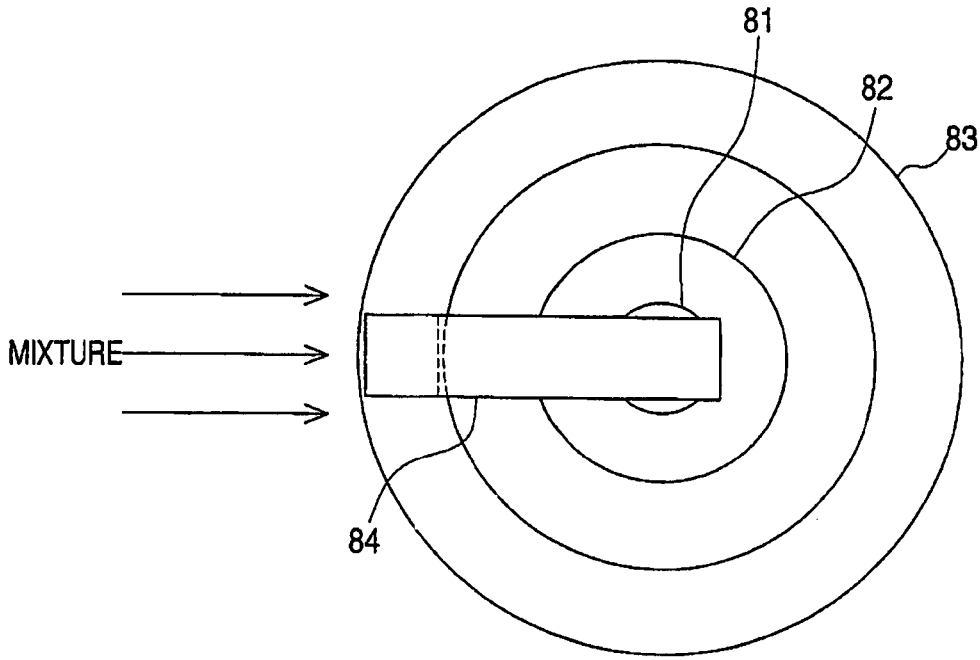
FIG. 11 is a top plan view showing the state of a spark plug of the prior art and taken from the leading end side.
Figure 12:
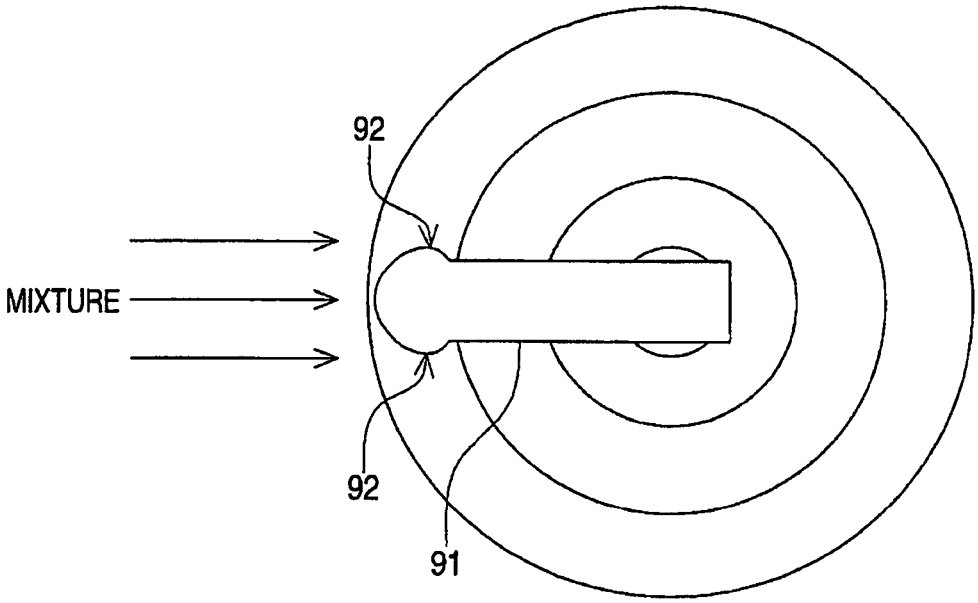
FIG. 12 is a top plan view showing the state of a spark plug of the prior art and taken from the leading end side.

(b) In the mode of embodiment, moreover, all the rod-shaped ground electrodes 4 used have the section of the same size and the same shape before they are bent, but they need not always have the rod shape. As shown in FIG. 10, therefore, there may be used a ground electrode 53, which includes a radially larger (or wider) rear portion 51 and a portion 52 radially smaller than the rear portion 51. As shown in FIG. 10, moreover, a taper portion 54 may be formed between the rear portion 51 and the radially smaller portion 52. In this structure, however, it is necessary that the maximum dmax of the width of the ground electrode 4 within the range of ±1 mm (the area p of FIG. 10) from the center point of the spark discharge gap in the axial direction, is suppressed at 105% or less of the width d0 of the ordinary portion (i.e., such a portion of the radially smaller portion 52 in FIG. 10 as has no relation to the bend)

(c) In the mode of embodiment, no detailed mention is. made on the detail of the curvature of the curved portion of the back of the ordinary portion of the ground electrode 4. The curvature can be thought in the following manner.

Generally speaking, the advantage of the around-inflow of the mixture is the higher, as the radius of curvature of the back of the ordinary portion of the ground electrode is the smaller. In this respect, it is desired that the radius of curvature of the curved portion of the back of the ordinary portion of the ground electrode 4 (shown as R in FIG. 2 with a center O) is 0.5 mm or more and 1.3 mm or less. In case the curvature radius is less than 0.5 mm, it is feared that the working may be seriously difficult. In case the curvature radius is more than 1.3 mm, it is feared that the joint to the metal shell 1 may be difficult. Here, it is desired that the ratio of the curved face portion (or the arcuate portion) to the total distance of the outer periphery of the section is 60% or more.

(d) Although not especially mentioned in the aforementioned mode of embodiment, the structure may be modified such that at least one bent portion is formed outside of the range of ±1 mm from the center point of the spark discharge gap in the axial direction. Alternatively, the ground electrode may also be formed by forming a plurality of bending points outside that range without forming them within the range of ±1 mm from the center point of the spark discharge gap in the axial direction.

(e) In the aforementioned mode of embodiment, the ground electrode 4 has the two-layered structure composed of the outer layer 4A and the inner layer 4B, but may be composed of one layer or may have a three-layered structure.

This application is based on Japanese Patent application JP 2006-68673, filed Mar. 14, 2006, and Japanese Patent application JP 2007-43057, filed Feb. 23, 2007, the entire contents of which are hereby incorporated by reference, the same as if set forth at length.

What is claimed is:

1. A spark plug comprising:

a center electrode extending in an axial direction of said spark plug;

a substantially cylindrical insulator disposed on an outer circumference of said center electrode;

a cylindrical metal shell disposed around said insulator; and a ground electrode including a bent portion bent at an intermediate portion of said ground electrode so that a rear end portion of said ground electrode is bonded to a leading end portion of said metal shell and a leading end portion of said ground electrode is opposed to a leading end face of said center electrode, wherein a spark discharge gap is provided between the leading end portion of said center electrode and the leading end portion of said ground electrode, and said ground electrode having a substantially circular or elliptical cross-section, the cross-section having a peripheral surface disposed along a side opposite to a side in which said center electrode is provided, and a maximum width of said ground electrode within a range of ±1 mm from a center point of said spark discharge gap in the axial direction, as viewed in a direction where said center electrode and said ground electrode overlap, is 101-105% of a width of an ordinary portion having a substantially constant width.

2. The spark plug as claimed in claim 1, wherein a ratio of a thickness of said ground electrode to said width of said ordinary portion is 0.5 or more.

3. The spark plug as claimed in claim 1, wherein a Vickers hardness of a portion of said ground electrode having said maximum width is from 140% to 170% of a Vickers hardness of said ordinary portion.

4. The spark plug as claimed in claim 2, wherein a Vickers hardness of a portion of said ground electrode having said maximum width is from 140% to 170% of a Vickers hardness of said ordinary portion.

5. The spark plug as claimed in claim 1, wherein a radius of curvature of said curved face of said ordinary portion of said ground electrode is from 0.5 mm to 1.3 mm.

6. The spark plug as claimed in claim 2, wherein a radius of curvature of said curved face of said ordinary portion of said ground electrode is from 0.5 mm to 1.3 mm.

7. The spark plug as claimed in claim 3, wherein a radius of curvature of said curved face of said ordinary portion of said ground electrode is from 0.5 mm to 1.3 mm.

8. The spark plug as claimed in claim 4, wherein a radius of curvature of said curved face of said ordinary portion of said ground electrode is from 0.5 mm to 1.3 mm.

9. The spark plug as claimed in claim 1, wherein said ground electrode includes an outer layer and an inner layer made from a metal having a higher thermal conductivity than that of said outer layer, and a ratio, as taken in a section of said ordinary portion, of a sectional area of said inner layer to an sectional area of said ordinary portion is from 25% to 60%.

10. The spark plug as claimed in claim 1, wherein said ground electrode has at least one bent portion positioned outside of said range of ±1 mm from the center point of said spark discharge gap in said axial direction.

11. The spark plug as claimed in claim 1, wherein the ground electrode including a bent portion is bent by one or more of a method of bending slowly for a long time, a method of bending at multiple stages while changing bending points and a method of bending while holding a portion which might otherwise be widened.

* * * * *